US005173348A

United States Patent [19]

Gevaert et al.

[11] Patent Number: 5,173,348

[45] Date of Patent: Dec. 22, 1992

[54] TABLE EDGING SYSTEM

[75] Inventors: Steven C. Gevaert; Robert L. Blank, both of Green Bay, Wis.

[73] Assignee: Krueger International, Inc., Green Bay, Wis.

[21] Appl. No.: 609,998

[22] Filed: Nov. 7, 1990

[51] Int. Cl.[5] ..... B32B 3/06

[52] U.S. Cl. ..... 428/100; 428/99; 428/120; 428/122; 428/157; 428/192; 52/783; 52/784; 52/823; 52/826; 312/137

[58] Field of Search ..... 428/192, 157, 99, 120, 428/122, 100; 52/783, 784, 823, 826; 248/345.1; 49/462; 312/137; 108/27

[56] References Cited

U.S. PATENT DOCUMENTS

| | | | |
|---|---|---|---|
| 1,235,431 | 7/1917 | Burrowes | 52/823 |
| 2,549,414 | 4/1951 | Bonnell | 52/823 |
| 2,821,754 | 2/1958 | Hillson | 52/823 |
| 2,846,283 | 8/1958 | Pasewalk | 52/783 |
| 2,884,669 | 5/1959 | Hillson | 52/823 |
| 2,940,805 | 6/1960 | Nordmark | 108/27 |
| 3,190,783 | 6/1965 | Tarnok | 156/489 |
| 4,368,564 | 1/1983 | Martin | 24/458 |
| 4,766,821 | 8/1988 | Pauer | 248/188 |
| 4,810,550 | 3/1989 | Gasser | 428/217 |

FOREIGN PATENT DOCUMENTS

| | | | |
|---|---|---|---|
| 2602653 | 2/1988 | France | 248/345.1 |

*Primary Examiner*—Ellis P. Robinson
*Assistant Examiner*—Nasser Ahmad
*Attorney, Agent, or Firm*—Fuller, Ryan, Hohenfeldt & Kees

[57] ABSTRACT

A table edging system for application to the edge of a foldable banquet table. The edging system includes extruded edging pieces applied to the table edge along each of the four sides of the table, and four molded corner pieces, one for application to each of the four corners. Each extruded edging piece is formed of a first flat portion, designed to contact the underside of the table. A second portion connects with the first portion at a point spaced apart from either side edge thereof and is positioned substantially normal to the first plane. A third portion also connects with the first portion at one of the side edges thereof. The third portion is positioned in a plane substantially parallel to but offset from the first portion. The length of the third portion is substantially the same as the thickness of the table edge. At the upper edge of the third portion is a tapered flange to overly the top surface of the table. Each of the four corner pieces includes flat portions generally aligned with the flat portions of the edging pieces and having one edge thereof being smoothly curved through a 90° arc.

14 Claims, 1 Drawing Sheet

TABLE EDGING SYSTEM

BACKGROUND OF THE INVENTION

This invention relates to table edging systems and parts for large tables, and in particular to improvements over the existing systems where the edging and apron of the table are separated.

As shown in Gasser, U.S. Pat. No. 4,810,550, it is conventional to provide a table edge or scuff plate which is adhered strictly to the edge of the table. As indicated in the Pauer et al. patent, U.S. Pat. No. 4,766,821, it is well known to affix an apron to the underside of a table. While the particular apron shown in the Pauer et al. patent is specifically adapted to be used in the attachment of a table leg, such is not normally the case in banquet tables, where the legs are normally attached to the center underside of the table, and foldable. Neither of these patents, however, suggests structure for combining the apron and the edging into a single unit.

The Martin patent, U.S. Pat. No. 4,368,564 shows a ring intended to be applied to a glass tabletop. This ring includes an upper flange portion and a lower bead or lip. However, because of the adaptation of this structure to a glass top, it is not directly applicable to conventional folding banquet tables. In fact, the Tarnok patent, U.S. Pat. No. 3,190,783 suggests a unitary edging to be applied in one piece about the entire circumference of the edge of the table.

A need therefore exists in the market for an edging system which combines the edging itself with the apron, saving substantial labor and expense. This invention relates to improvements to the devices described above, and to solutions to some of the problems raised or not solved thereby.

SUMMARY OF THE INVENTION

The invention relates to a table edging system for application to the edge of a rectangular table, such as a foldable banquet table In the preferred embodiment, this edging system includes extruded edging pieces applied to the table edge along each of the four sides of the table, and four molded corner pieces, one for application to each of the four corners. It is intended that each corner piece butt with and be positioned between an adjacent pair of extruded edging pieces above the edge of the table.

Each of the four extruded edging pieces is formed of a first portion disposed in a first plane. That first plane has first and second substantially flat surfaces and two side edges. The first surface is designed to contact the underside of the table. Each edging piece also includes a second portion integrally formed with the first portion The second portion connects with the second surface of the first portion at a point spaced apart from either side edge of the first portion, and is positioned in a second plane substantially normal to the first plane. Each edging piece also includes a third portion integrally formed with the first portion, connecting with the first surface of the first portion, at one of the side edges thereof The third portion is positioned in a third plane substantially parallel to but offset from the second plane. The length of the third portion is substantially the same as the thickness of the table edge. At the upper edge of the third portion is a flange integrally formed therewith disposed in a fourth plane generally parallel to but offset from the first plane so as to overly the top surface of the table.

This flange is thicker at the edge where it attaches to a third portion and thinner at the distal edge, tapering smoothly.

Each of the four corner pieces includes a first generally flat portion generally aligned with the first portion of the edging pieces and having one edge thereof being smoothly curved through a 90° arc. A second portion is integrally formed with the first portion of the corner piece, connecting with the underside thereof and aligned generally with the second portion of the adjacent edging pieces. The second portion thus has two sides substantially mutually perpendicular, joined by a smooth curved bight segment. A third portion is integrally formed with the corner piece first portion, opposite the second portion. This third portion is connected to the first portion all along the curved edge thereof, thus again having two sides substantially mutually perpendicular, enjoined by a smooth curved bight segment offset from the bight segment of the second portion. At the top of the corner piece third portion is formed a flange, disposed in a plane generally parallel but offset from the plane in which the first portion lies. Hence, the flange overlies the top surface of the table. In order to conform with the extruded edging pieces, the flange tapers smoothly from a thicker area where connected to the corner piece third portion to a thinner area. Reinforcing means are attached to or integrally formed with the bight segment of the third portion. Hence, the invention provides a table edging system with superior cost attributes and no sacrifice in integrity or appearance. Other objects and advantages of the invention will appear hereinafter.

DESCRIPTION OF THE PREFERRED EMBODIMENT

Figure 1:
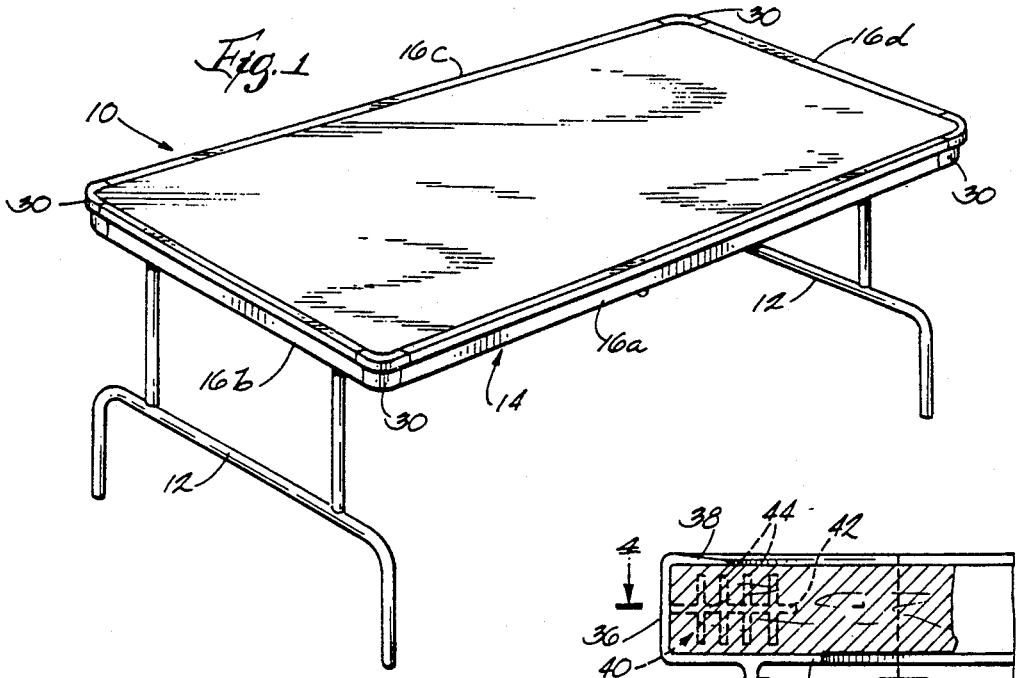
FIG. 1 is an isometric view of a banquet table having the edging system applied thereto according to a preferred embodiment of the invention.

Referring now to FIG. 1, there is shown a banquet table 10 of a generally conventional type, having a pair of leg sets 12 which may be foldable, although this feature is not required, and certainly forms no part of the invention. While the term "banquet table" will be used hereinafter as a prime example of a candidate to which this invention is intended to be applied, the invention may be applied equally well to a large number of other types of tables, wherever it may be desirable to combine the protective edge with the apron.

As shown in FIG. 1, there is applied to the entire outer edge of the table an edging system 14. According to the invention, this edging system includes four extruded edging pieces **16*a*, 16*b*, 16*c* and 16*d*, each applied to a respective straight edge of the table 10. Each such edging piece 16 reaches, at each end, to within a predetermined distance of the respective corner of the table. Note that since the table is rectangular in shape, two edging pieces 16***a* and 16*c* are one length while the other two pieces 16*b* and 16*d* are of a shorter length. The edging pieces are referred to hereinafter as extruded, although any suitable method of forming these pieces could be used.

Figure 2:
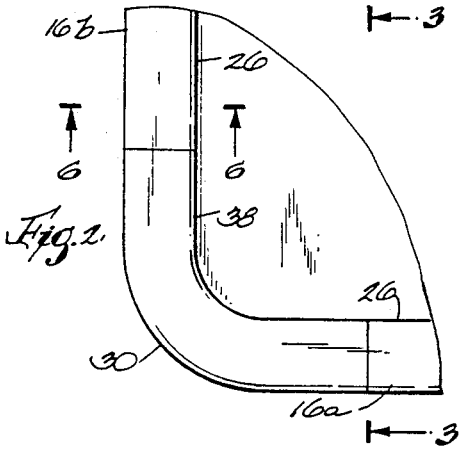
FIG. 2 is a top fragmentary view of a corner of the table shown in FIG. 1.
Figure 6:
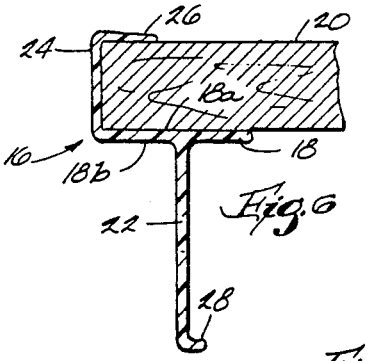
FIG. 6 is a cross-sectional view of the extruded edging piece shown in FIG. 2, taken generally along line 6—6.

As can be seen by comparing FIGS. 2 and 6, each of the edging pieces 16 is integrally formed. Each such edging piece 16 includes a first flat portion 18, as shown herein generally disposed in a horizontal plane. Accordingly, this first portion 18 has a flat upper surface and a flat lower surface. As shown in FIG. 6, the flat upper surface contacts the lower outer edge 20 of the table 10.

A second portion 22 of the edging piece is integrally formed with the first portion 18. This second portion 22 connects with the lower surface 18*b* of first portion 18 and projects in the second plane substantially normal to the plane of the first portion. The connection point between the second portion and the first portion is not at either edge of the first portion, and is spaced apart from either such side edge.

The extruded edging piece also includes a third portion 24 integrally formed with the first portion and connecting thereto at one side edge of the first portion. From its connection point to the first portion, the third portion projects substantially normal to the first portion, and projects upward to the extent of about equal to the thickness of the table edge 20. As can be seen in FIG. 6, the length of the second portion 22 is substantially longer than the length of the third portion 24.

At the upper edge of the third portion is integrally formed a flange 26. This flange 26 is provided so that the extruded edging piece protects the upper edge of the table as well as the lower edge.

In the most preferred embodiment, the flange 26 is tapered from a thicker area where it connects to the third portion 24 to a thinner area at the opposite edge. In the most preferred embodiment, this taper is accomplished by forming the lower edge of flange 26 flat, while the upper edge of flange 26 is slanted downward from its point of attachment to third portion 24 smoothly toward its distal edge.

A small lip of flange 28 may be formed at the distal end of second portion 22, in order to improve the strength of the edging piece.

Figure 3:
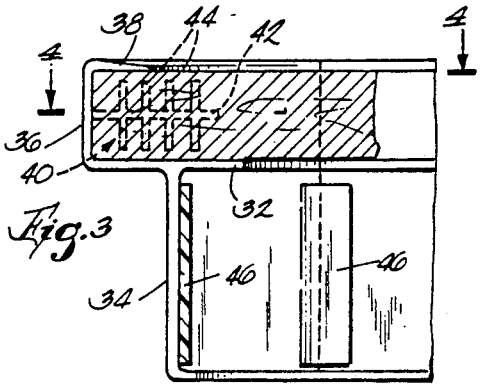
FIG. 3 is a cross-sectional view of FIG. 2, taken generally along line 3—3.
Figure 4:
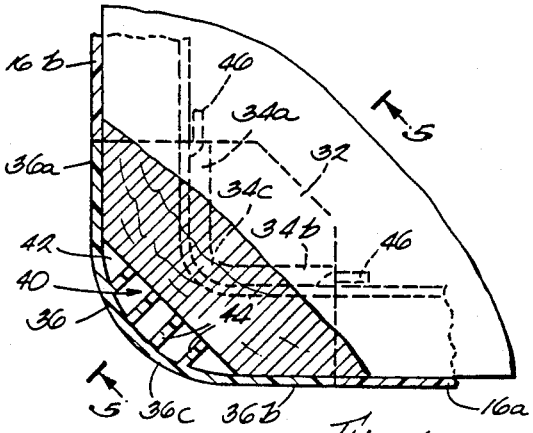
FIG. 4 is an enlarged top view of a corner of the table shown in FIG. 1, partially cut away so as to show the internal structure of the corner piece.
Figure 5:
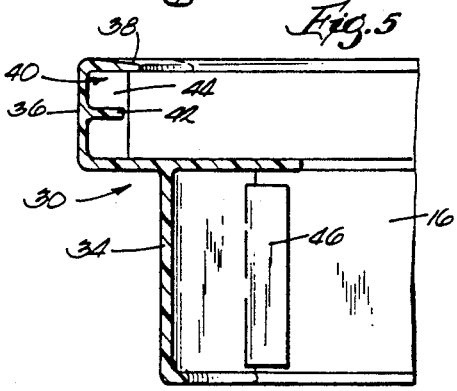
FIG. 5 is a cross-sectional view of the corner piece shown in FIG. 4, taken generally along lines 5—5 thereof.

As also shown in FIG. 1, the table edging system 14 includes corner pieces 30 which are generally aligned with and provide a smooth appearance with the extruded edging pieces attached along the side edges of the table. As shown in FIGS. 3, 4 and 5, this corner piece is generally molded of plastic, although it may be formed by any suitable process and of any suitable material. In the preferred embodiment, the corner piece includes a first portion 32 which is substantially flat and positioned horizontally. As can be seen by comparing FIGS. 3 and 4, this first portion has an edge which is curved through a 90° arc. Each corner piece includes a second portion 34 integrally formed with the first portion connecting to the underside of the first portion. This second portion has two sides which are substantially mutually perpendicular and joined by a smooth curved bight segment 34*c* and the two sides of 34*a* and 34*b*, best shown in FIG. 4. A third portion 36 is integrally formed with the first portion, on the top surface thereof, and connected to the first portion all along the curved edge thereof. Thus, again the third portion 36 has two side segments 36*a* and 36*b* which are substantially mutually perpendicular, joined by a smooth, curved bight segment 36*c* offset from the bight segment 34*c* of the second portion 34.

Similar to the extruded edging piece, the corner piece 30 has a flange 38 formed at the top of third portion 36, which flange is inward facing. This flange 38 is disposed in a plane parallel to but off-set from the plane of first portion 32. In addition, the flange 38 is tapered from a thicker edge where it attaches to third portion 36 smoothly to a thinner area distally.

In the most preferred embodiment, certain additional features are provided in order to improve the structural integrity of the assembled table edging system. One of these features is reinforcing means 40 of the corner pieces 30. In the preferred embodiment, the reinforcing means includes a horizontal flange 42 formed horizontally along the bight segment 36*c* of the third portion 36. As shown best in FIG. 4, the edge of flange 42 facing the table is generally flat. In addition, vertical ribs 34 are formed in the same area and intersect with the flange 42.

Another such feature is the addition of side flanges 46 which are attached to or integrally formed with second portion 34, at the distal edges thereof. These side flanges 46 are designed and intended to overlie the adjacent second portions 22 of the extruded edging pieces 16, again to improve the structural integrity of the assembled edging system.

While the apparatus herein and before described is effectively adapted to fulfill the aforesaid objects, it is to be understood that the invention is not intended to be limited to the specific preferred embodiments of the table edging system set forth above. Rather, it is to be taken as including all reasonable equivalents within the scope of the following claims.

We claim:

1. An extruded table edging for application to a table edge, comprising:

a first portion disposed in a first plane, said first portion having first and second substantially flat surfaces and two side edges, said first surface contacting the underside of the table;

a second portion integrally connecting with said second surface of said first portion at a point spaced from either side edge of said first portion, said second portion positioned in a second plane substantially normal to said first plane; and a third portion integrally connecting with said first surface of said first portion, at one of said side edges of said first portion, and positioned in a third plane substantially parallel to but spaced apart from said second plane, the length of said third portion being substantially the same as the thickness of the table edge;

the length of said second portion being longer than that of said third portion.

2. An extruded edging as recited in claim 1 wherein said third portion has an upper edge opposite the part of said third portion connecting to said first portion, and further comprising a flange integrally formed with the upper edge of said third portion and disposed in a fourth plane generally parallel to but spaced apart from said first plane so as to overlie the top surface of the table.

3. An extruded edging as recited in claim 2 wherein said flange is thicker at the edge where said flange attaches to said third portion and thinner at the opposite edge.

4. An extruded edging as recited in claim 3 wherein said flange tapers smoothly between its thicker area and its thinner area.

5. An extruded edging as recited in claim 3 wherein said flange has a lower surface which is flat and an upper surface which is slanted between the thicker area and the thinner area.

6. An extruded edging as recited in claim 1 wherein said second portion has an edge distal from its area of connection to said first portion, and further comprising a small flange integrally formed with said distal edge and positioned substantially normal to said second portion.

7. A table edging system for application to the edge of a rectangular table having a plurality of sides and corners, comprising in combination:

A. a number of extruded edging pieces for application to the table edge along the sides, each such piece including:

1) a first portion disposed in a first plane, said first portion having first and second substantially flat surfaces and two side edges, said first surface contacting the underside of the table;

2) a second portion integrally connecting with said second surface of said first portion at a point spaced from either side edge of said first portion, said second portion positioned in a second plane substantially normal to said first plane; and 3) a third portion integrally connecting with said first surface of said first portion, at one of said side edges of said first portion, and positioned in a third plane and substantially parallel to but spaced apart from said second plane, the length of said third portion being substantially the same as the thickness of the table edge; and B. a number of molded corner pieces for application to each of the four corners, each corner piece butting with and positioned between an adjacent pair of said edging pieces, each such corner piece including:

1) a first portion disposed in a first plane, aligned generally with said first portion of said edging pieces, and having one edge thereof being curved through an arc sufficient to permit said first portion to contact two adjoining sides of the table edge;

2) a second portion integrally connecting to the underside of said first portion and aligned generally with said second portion of said adjacent edging pieces, said corner piece second portion thus having two perpendicular sides, and joined by a smooth curved bight segment; and 3) a third portion integrally connected to said first portion all along said curved edge thereof, thus having two perpendicular sides and being joined by a smooth curved bight segment offset from said bight segment of said second portion.

8. A molded corner piece for application to a corner of a table, each such corner piece comprising:

a first portion disposed in a first plane and having one edge thereof being curved through an arc;

a second portion integrally connecting to the underside of said first portion, said second portion thus having two perpendicular sides joined by a smooth curved bight segment; and a third portion integrally connected to said first portion all along said curved edge thereof, thus having two perpendicular sides joined by a smooth curved bight segment offset from said bight segment of said second portion;

the length of said second portion being longer than that of said third portion.

9. A molded corner piece as recited in claim 8 wherein said third portion has an upper edge opposite the part of said third portion connecting to said first portion, and further comprising a flange integrally formed with the upper edge of said third portion and disposed in a plane generally parallel to but spaced apart from said first plane so as to overlie the top surface of the table.

10. A molded corner piece as recited in claim 9 wherein said flange is thicker at the edge where said flange attaches to said third portion and thinner at the opposite edge.

11. A molded corner piece as recited in claim 10 wherein said flange tapers smoothly between its thicker area and its thinner area.

12. A molded corner piece as recited in claim 10 wherein said flange has a lower surface which is flat and an upper surface which is slanted between the thicker area and the thinner area.

13. A molded corner piece as recited in claim 8 wherein said second portion has an edge distal from its area of connection to said first portion, and further comprising a small flange integrally formed with said distal edge and positioned substantially normal to said second portion, said small flange thus having two side segments substantially mutually perpendicular, and joined by a smooth curved bight segment.

14. A molded corner piece as recited in claim 9 including means for reinforcing said third portion bight segment.

* * * * *